US005676323A

United States Patent [19]

Wirz et al.

[11] Patent Number: 5,676,323

[45] Date of Patent: Oct. 14, 1997

[54] APPARATUS AND METHOD FOR CHANGING AND WINDING BOBBINS INVOLVING THE CORRECTION OF MOVEMENT SEQUENCES IN A MOVING ELEMENT

[75] Inventors: Armin Wirz, Ossingen; Arthur Haag, Winterthur; Peter Busenhart, Wiesendangen; Thomas Gisel, Thun, all of Switzerland

[73] Assignee: Maschinenfabrik Rieter AG, Winterthur, Switzerland

[21] Appl. No.: 649,540

[22] Filed: May 17, 1996

Related U.S. Application Data

[63] Continuation of Ser. No. 137,199, Oct. 26, 1993.

[30] Foreign Application Priority Data

Mar. 6, 1992 [CH] Switzerland ..... 00729/92
Jul. 17, 1992 [CH] Switzerland ..... 02272/92

[51] Int. Cl.[6] ..... B65H 67/044; B65H 63/00; G06F 19/00; D01H 9/10

[52] U.S. Cl. ..... 242/18 A; 242/36; 57/264; 364/470

[58] Field of Search ..... 242/18 A, 35.5 T, 242/25 A, 36; 57/264; 364/470

[56] References Cited

U.S. PATENT DOCUMENTS

| | | | |
|---|---|---|---|
| 4,512,526 | 4/1985 | Tone et al. | 242/36 |
| 4,709,866 | 12/1987 | Schefer | 242/18 A |
| 4,741,485 | 5/1988 | Flueli et al. | 242/18 A |
| 4,770,356 | 9/1988 | Mueller et al. | 242/18 A |
| 4,815,502 | 3/1989 | Takegawa . | |
| 4,843,290 | 6/1989 | Sainen et al. . | |
| 4,854,515 | 8/1989 | Tone | 242/36 |
| 4,964,582 | 10/1990 | Hermanns et al. | 242/36 |
| 5,016,829 | 5/1991 | Schippers et al. | 242/18 A |
| 5,029,762 | 7/1991 | Behrens et al. | 242/18 A |
| 5,159,804 | 11/1992 | Schippers et al. . | |
| 5,219,125 | 6/1993 | Rigg | 242/18 A |

FOREIGN PATENT DOCUMENTS

| | | |
|---|---|---|
| 0 228 089 | 7/1987 | European Pat. Off. . |
| 0 256 487 | 2/1988 | European Pat. Off. . |
| 0 417 599 | 3/1991 | European Pat. Off. . |
| 29 44 219 | 7/1980 | Germany . |

OTHER PUBLICATIONS

Patent Abstract of Japan, JP 30 42 430, vol. 15, No. 182, (M-1111) May 1991.

Patent Abstract of Japan, JP, A, 30 73 725, vol. 15, No. 235, (M-1125) Jun. 1991.

*Primary Examiner*—Michael Mansen

*Attorney, Agent, or Firm*—Burns, Doane, Swecker & Mathis, LLP

[57] ABSTRACT

A textile machine with an apparatus for recognizing and correcting deviations of sequences of movements of an element (31) driven by a driving element (33). A device (51) acquires the arrival time ($t_4$) of the driven element (31) and corrects the start time ($t_1$) of the driving element (33) within a predefined time window ($t_{1u}$–$t_{1o}$) until the arrival time ($t_4$) of the driven element (31) lies within a predefined time window ($t_{2u}$–$t_{2o}$) again.

20 Claims, 5 Drawing Sheets

FIG. 1
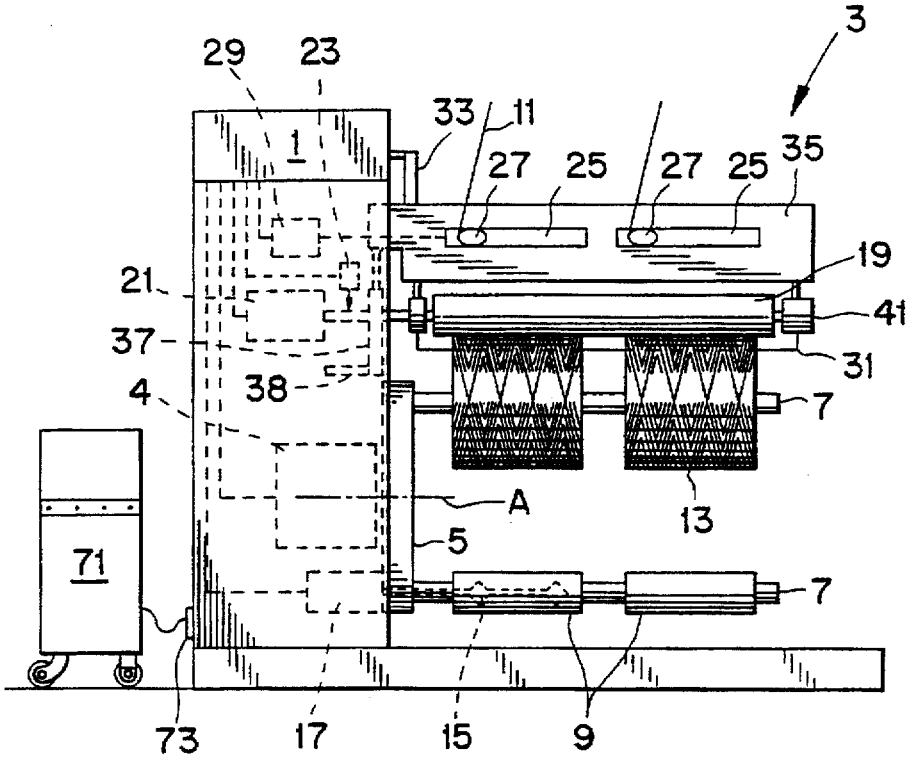
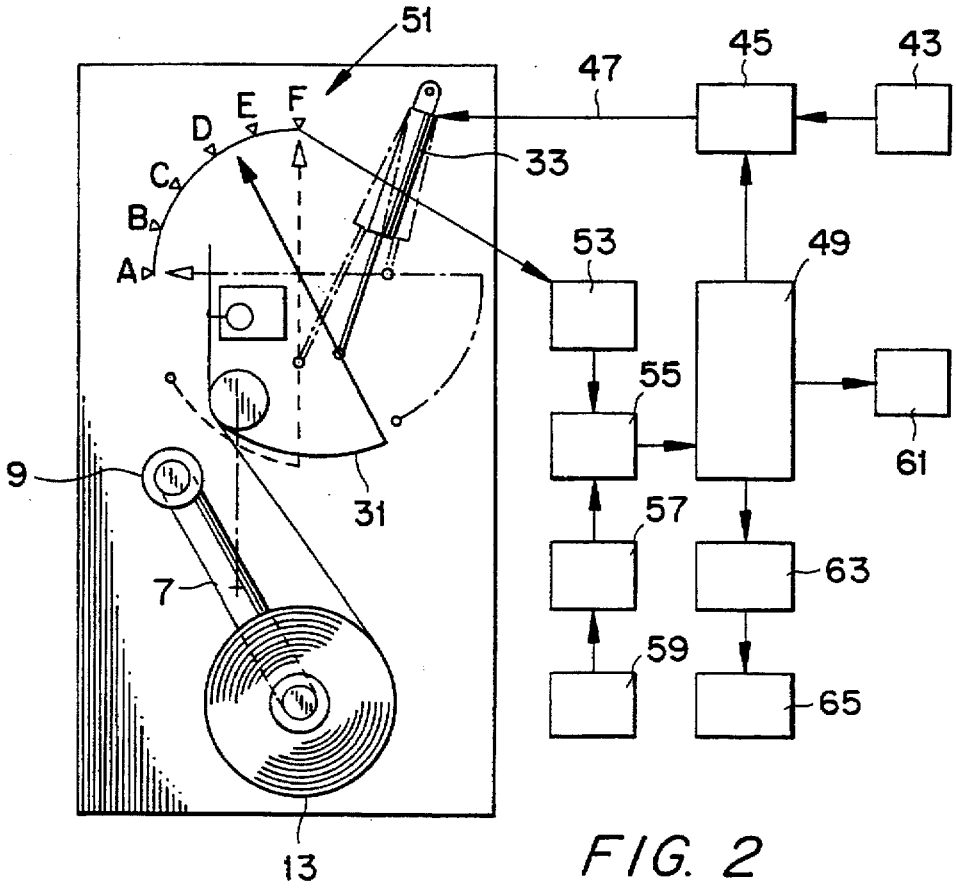
FIG. 2

APPARATUS AND METHOD FOR CHANGING AND WINDING BOBBINS INVOLVING THE CORRECTION OF MOVEMENT SEQUENCES IN A MOVING ELEMENT

This application is a continuation of application Ser. No. 08/137,199, filed Oct. 26, 1993.

The object of the present invention is a method for monitoring and correcting sequences of movements of moved elements pursuant to the preamble of claim 1 and a bobbin winding machine with an apparatus for monitoring and correcting sequences of movements of moved elements pursuant to the preamble of claims 4, 9 and 10.

Yarns made from textured filaments are wound onto empty bobbins at very high speeds, usually some several thousand metres per second. After reaching the predefinable quantity of yarn on the bobbin, the latter is automatically swivelled into a removal position and at the same time an empty bobbin is brought from the waiting position, which is equivalent to the later removal position, to the winding position. The transfer of the yarn running onto the full bobbin to the empty bobbin is made fully automatically and without producing any waste. Various methods and apparatuses are known from the state of the art in which the bobbins or empty bobbins are situated on a rotatable revolver which can be swivelled for changing the bobbins. For transferring the incoming yarn, yarn lifting apparatuses for lifting the yarn from the jig motion device, means for guiding the yarn running towards the centre of the bobbin to the side, means for lifting the yarn which is still running towards the full bobbin from the transfer area to the winding position of the new empty bobbin as well as means for the lateral deflection of the yarn through a catch slot in the empty bobbin are required. All said mechanical movable means for handling (deflecting, displacing, etc.) the yarn must begin their movement at a precisely defined time and carry out a predefined path within a predefined time and/or with a predefined sequence of speeds. The control signals required for this purpose are stored in a memory-programmable control unit and are supplied and monitored by said unit at predefined times to the mechanical drives (actuators) which drive the means. Further control means (sensor units) are used to monitor the arrival at the end positions of said mechanical drives in the known apparatuses. Any failure to carry out a movement can therefore be determined by the nonarrival of the driven means at the target site. It is also known to coordinate the mutual activities of mechanical elements and the signals for the drives (actuators) in order to prevent a wrong temporal sequence of the movements, which could lead to the collisions of two or more elements passing through a certain coordinate.

As in other methods in the field of textile production, quality problems in the production of yarn can also come about by a temporally imprecisely coordinated and synchronized combination of two machine elements which are carrying out a movement. Such problems occur when the revolver does not reach the predefined angular position in which the winding and/or the contact with the tachometer roller ought to take place at the correct place and time during the change of a bobbin. The angular position of the revolver determines the distance of the empty bobbin from the tachometer roller. Even a small angular error of the revolver with respect to the tachometer roller can lead to quality impairments.

Angular positioning errors of the revolver are caused by ageing, tolerances or impurities both with respect to the revolver (driven element) as well as its driving means (driving element). A continuous monitoring for maintaining high quality is indispensable. The same problems arise in connection with movements that occur linearly when the elements of a length measuring system are afflicted with different tolerances or are temperature dependent.

The machine control units of known automatic bobbin winders can determine when a movement has not been carried out or has not been carried out completely because the driven element has not reached the target precisely. However, sequences of movements which do not take place in the predefined manner, irrespective of whether the movement is linear or nonlinear, are not monitored and the resulting changes of the temporal sequence of the process steps and thus possible defects in the final product can only be determined after a yarn breakage or possibly during the further processing of the bobbin or the final product per se. This can lead to the fact that over a lengthy period such as minutes, hours or days, expensive rejects are produced due to a slight change of the sequence of movements, be it with respect to the path covered or with respect to the temporal sequence. In addition, it is no longer possible to determine whether the rejects would suffice for a lower quality grade or whether they would be totally unusable.

From the German specification 2944219 a method and an apparatus is known with which the function of a processing unit is controlled in a mechanical respect and which also allows its setting and actuation in the event that it is not dynamically balanced and the time sequence of its actual start-up and turn-off processes deviate from the respective permitted time tolerance ranges.

The invention intends to remedy this.

The invention as characterized in claims 1, 4, 9 and 10 offers a solution to this problem in creating a method and a bobbin winding machine which monitors and corrects the temporal combinations of the moved elements taking part in the change of the bobbins with respect to the path, site and/or time covered.

The method in accordance with the invention allows acquiring the momentary sites and/or the sequence of the movement with respect to the momentary speed of the mechanical elements included in the monitoring and a respective correction of the control impulses which control the drives of the driven elements. Within predefinable limits it is thus possible to correct the temporal combinations of the sequences of movements of pneumatic drive elements by changing the temporal sequence of the control impulses for compressed air supply, thus compensating for changes in the paths of movements or speeds of the movements due to increased friction or other influences from the set value or or the sequence of set values. At the same time it is possible to initiate any required measures in the event that threshold values of individual sequences of movements are exceeded, for example instant stop of the machine or stop of the machine after the next change of bobbin in order to avoid defective bobbins. It is also possible to mark bobbins with defects that have been determined. The marking allows a classification without having to separate all bobbins as being defective.

The method allows the monitoring and/or control of individual sequences of movements within the overall sequence and depending on the interaction between actuator and sensor elements. It is possible to record and correct within certain limits environmental influences such as temperature, humidity, contamination, etc. and production conditions such as measurement tolerances, installation impreciseness, ageing effects and wear and tear.

The invention allows acquiring a deviation from an angular path or a length of path at a predefined site and can bring about an approximation to the set value in the next following work cycle by a correction of the path or angular path. The correction can be continued until the set value is reached and/or repeated in the event of a new deviation therefrom.

The invention is now outlined in greater detail by reference to the illustrated embodiment, in which:

FIG. 1 shows a schematic representation of a bobbin winding machine;

FIG. 2 shows a schematic representation of a monitoring apparatus with a diagram;

Figure 3:
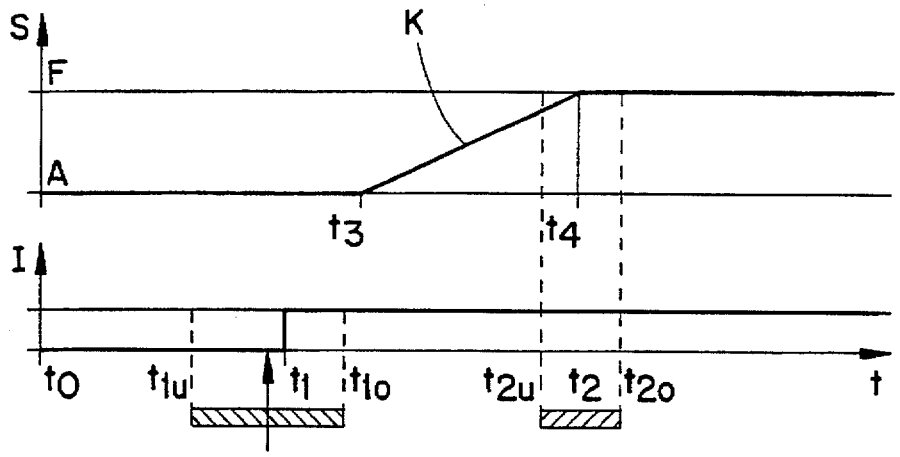
FIG. 3 is a chart illustrating a pneumatically moved component and the logic signal for the pneumatic valve of the drive means.

In casing 1 of an automatic bobbin winder 3 there are two revolvers 5 swivellable about the axis A by means of a drive 4 such as a stepper motor or a pneumatic motor drive. Two pegs 7 are rotatably held on the revolver 5. Empty bobbins 9 are placed on the pegs 7 for receiving a bobbin 13 made up of a yarn 11 which is supplied to said bobbin. The empty bobbins 9 are rotationally rigidly held by known clamping means 15 which are built into the pegs 7. The clamping means 15 are effectively connected with a clamping means drive 17 such as a pneumatic drive. For obtaining an even bobbin surface and, at the same time, for verifying the surface speed of the bobbins 13, they are in frictional contact with a driven tachometer roller 19 during the winding. The tachometer roller 19 preferably comprises an electric drive 21 and a tachometer 23 for determining the circumferential speed of the tachometer roller 19.

A laying apparatus 25 with yarn guiding means 27 which is allocated to the individual bobbins 13 is attached above the tachometer roller 19. The drive of the laying apparatus and its yarn guiding means 27 is made through a motor 29.

A swivellable yarn deflection and changer apparatus 31 is articulated on the casing of bobbin winding machine 3 and movable by a pneumatic drive 33 from an initial or idle position A via several intermediate positions B, C, D, G to a changing position F and back to the idle position A.

In order to maintain a constant contact pressure of the tachometer roller 19 on the bobbin surfaces, the tachometer roller 19 is held on an extension arm 35, which arm is vertically movable in a vertical guiding means in the casing of bobbin winding machine 3. The load of arm 35 rests on pneumatically or hydraulically actuated linear drives 37, which are fed by a pneumatic or hydraulic pressure source 38. Pressure sensors 41 are built into in the bearings of tachometer roller 19, for example, for monitoring the contact pressure of the tachometer roller 19 on the bobbin surface. In addition to the above mentioned driven elements and their driving elements it is clear that additonal components are provided in the bobbin winding machine which are not explained here, but the function of which is not relevant for the description of the present invention.

For the purpose of providing a detailed explanation of the first example of the invention the swivelling movement of the yarn changer apparatus 31 as driven element and its pneumatic linear drive 33 as the driving element shall be used here (FIG. 2).

A solenoid valve 45, which on the one hand is connected with a tube conduit 47 to the linear drive 33 and on the other hand with an electronic control unit 49 arranged in the bobbin winding machine 3, is fed by a compressed air source 43. The path of movement of the yarn changer apparatus 31 is monitored by a path sensor 51 with respect to the final positions A and F and, if desired, also with respect to the intermediate positions B, C, D and E. The monitoring of the path of movement can also be made additionally with respect to the temporal sequence of the movement between the final positions A and F or with respect to all intermediate positions B to E. The intermediate positions B to E can be stations in which the yarn changer apparatus 31 is temporarily put out of operation or they can measuring positions which are used to monitor the path of the movement with respect to the place and the time between the final positions A and F. The path sensor 51 preferably consists of sensor elements (linear potentiometers, etc.) which operate on a touch-free basis and which are able to acquire the momentary position of the yarn changer apparatus 31. Such sensors are commercially available and shall not be explained in greater detail.

Path sensor 51 is connected to an evaluator circuit 53 which converts the acquired measured values into electrical signals. The evaluator circuit 53 is further connected with a comparator circuit 55 which compares the measured values of path sensor 51 with the set values stored in the set point device 57. The set point device on the other hand is connected with a trigger 59. The results of the comparator circuit 55 are advanced to the control unit 49 for further processing.

A line leads from the control unit 49 to an alarm unit 61 which may comprise an optical or acoustic display or devices for switching off the bobbin winding machine 3. An additional line leads to a memory 63 (Memo) and from there to a display and/or printer 65 for the display of the operating condition and/or other data.

The sequence of the movements of the yarn changer apparatus with respect to the path and the time depends in the selected and described example on the position of revolver 5 or the diameter of the full bobbin 13 and the empty bobbin 9 on revolver 5. For the purpose of explaining the sequence of movements of the yarn changer apparatus 31 it is assumed that the swivelling process of revolver 5 takes place precisely in the predefined manner as relates to path and time. A pertinent path/time monitoring unit may be provided.

In FIG. 3 the (electric) logic signals issued at the precise time as predefined by the control unit 49 to the pneumatic valve 45 for the compressed air supply of the linear drive 33 are compared with the path of the yarn changer apparatus (driven element) which was effectively covered. The lower diagram shows the switch-on time $t_1$ (set value) and the switching current I for the pneumatic valve 45 (driving element) as well as two time windows ($t_{1u}$–$t_{1o}$ and $t_{2u}$–$t_{2o}$), within which are located the switch-on time $t_1$ and the switch-off time $t_2$. The upper diagram shows the effective course of the yarn changer apparatus 31 (driven element) with respect to path and time. At time $t_o$, when the change from a full bobbin 13 to an empty bobbin 9 is initiated by the rotation of the revolver 5, the yarn changer apparatus 31 is in the swivelled out position as is shown in broken lines (FIG. 2). After the expiry of time $t_1$, the pneumatic valve 45 receives the command from the control unit 49 by supply of current to the solenoid valve to supply the linear drive 33 with compressed air via line 47. Due to the delay of pressure propagation in the line 47, a possible dilation of line 47 and/or friction between the piston and the cylinder the yarn changer apparatus 31 begins its clockwise swivelling movement only at time $t_3$. If the movement in accordance with curve K which extends in a straight line in the upper diagram of FIG. 3 runs at a uniform speed, the driven element will reach the final point F of the path to be covered at time $t_4$. The time $t_3$ of the beginning of the movement is not of importance if no other moved elements move into the path of movement of the yarn changer apparatus. This is assumed in the present example. Important is the time $t_4$ at which the yarn changer apparatus 31 reaches its target F. In the example shown $t_4$ lies within the time window between $t_{2u}$ and $t_{2o}$. The movement has occurred according to plan within the predefined limits both with respect to the path (final point F) and the time ($t_{2u}$–$t_{2o}$).

Figure 4:
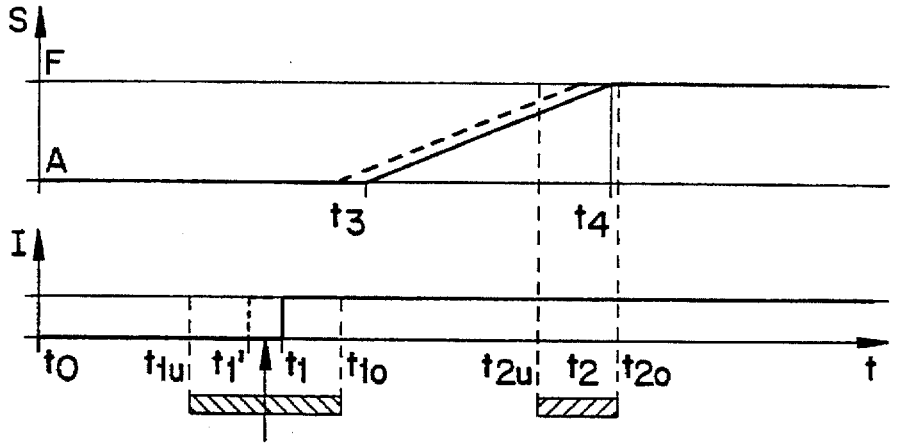
FIG. 4 is a chart illustrating a pneumatically moved component and the logic signal for the pneumatic valve of the drive means.

In the diagram in accordance with FIG. 4 the driven element, i.e. the yarn changer apparatus 31, reaches the final point F only shortly before the expiry of time $t_{2o}$. The arrival time $t_4$ is thus still within the time window $t_{2u}$ and $t_{2o}$, so that an interruption of the machine is not required. The delay in the arrival time may have been caused by increased friction in the driving or driven element, so that the starting time $t_1$ lies outside of the time window $t_{1u}$–$t_{1o}$. By providing a temporal advancement of the starting point $t_1$ to $t_{1'}$, which point can be defined precisely as it is made electronically and which, however, has to lie within the time window, it is possible to return the arrival time $t_4$ of the driven element to the central area of the time window $t_{2u}$–$t_{2o}$ (broken lines). The control unit 49 is designed in such a way that it tries to keep the arrival time $t_4$ as far as possible in the centre of the time window $t_{2u}t_{2o}$. In event of a deviation the return from the deviation is made in appropriate steps. The size of the steps can be selected proportionally to the size of the determined deviation, for example (closed control loop with integral character). The machine thus operates in the optimal range and an error message only occurs in the event of a severe malfunction in which the control unit is no longer able to make the correction within a sufficient magnitude (limit of the control range).

Naturally, the time window for the starting time of the movement cannot be expanded endlessly. It is necessary that it lies within certain limits which ensure that the driven element does not begin its movement too soon and does not collide with another element which is still situated in the area of the path of the driven element. The size of the window depends on various factors and has to be determined for every element individually. The upper and lower threshold of this window has to be selected in such a way that the machine remains operable. Phenomena of wear and tear or increased friction in the driven element can be corrected after each work cycle as long as the new starting point is situated within the time window $t_{1u}$–$t_{1o}$.

Figure 5:
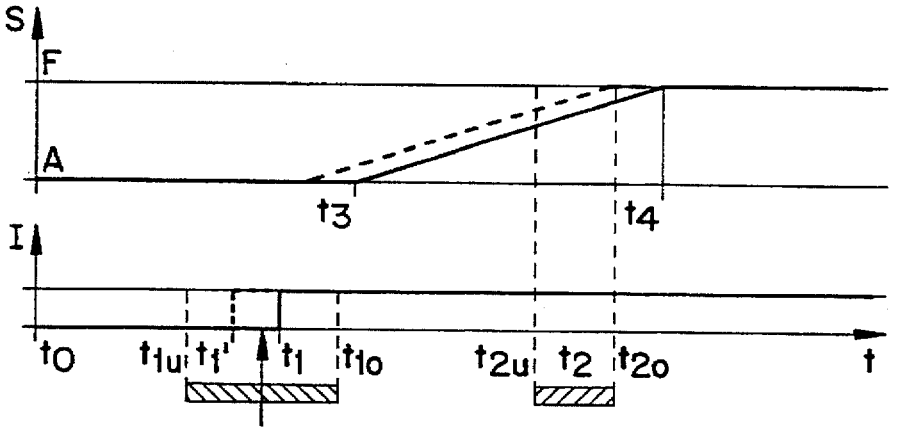
FIG. 5 is a chart illustrating a pneumatically moved component and the logic signal for the pneumatic valve of the drive means.

In the illustration in accordance with FIG. 5 the movement of the driven element, i.e. the yarn changer apparatus 31 again, has begun at the predefined time $t_3$, but it has taken longer because of increased friction in the linear drive 33, for example, and it reaches the final point F of the path of the movement only at time $t_4$. $t_4$ lies outside of the time window between $t_{2u}$ and $t_{2o}$. By providing a correction of the time $t_3$ by at least the time ($t_{4u}$–$t_{2o}$), but which still lies within the time window $t_{1u}$–$t_{1o}$, the time of arrival at the final point F can be pushed back into the time window $t_{2u}$–$t_{2o}$. In this event, however, it would be necessary to stop the machine first and issue an alarm signal and search for the cause of the deviation.

Figure 6:
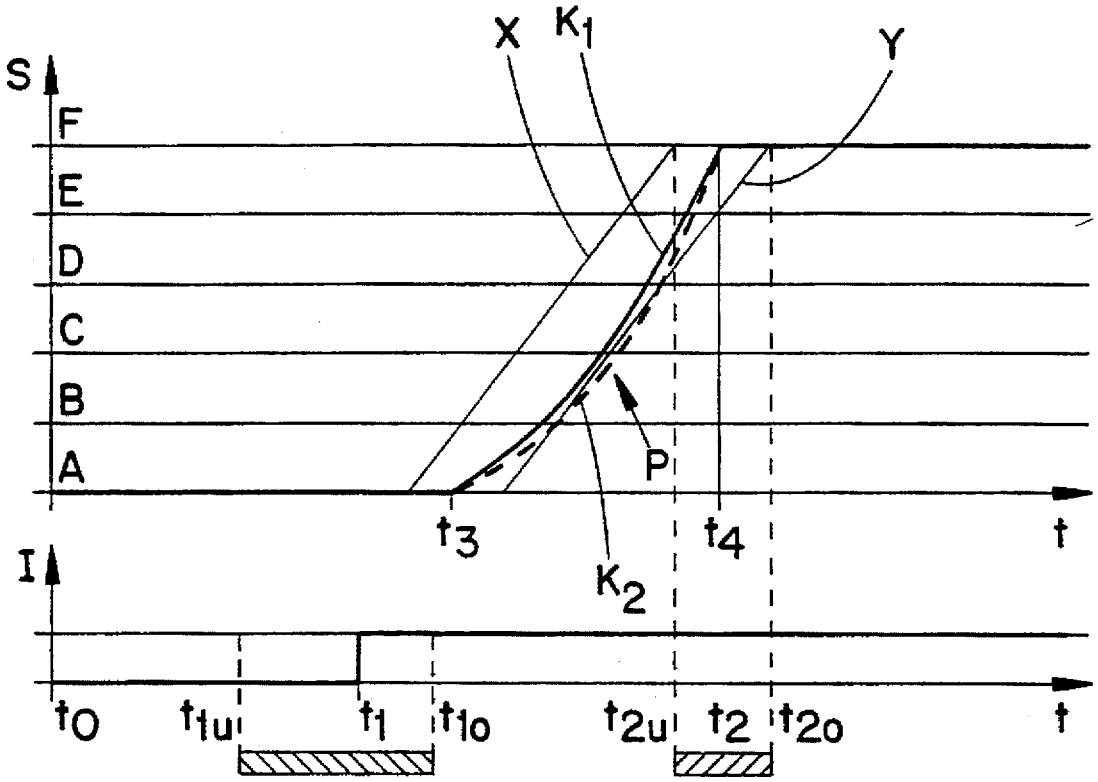
FIG. 6 is a chart illustrating a pneumatically moved component and the logic signal for the pneumatic valve of the drive means.

In the embodiment of the invention pursuant to FIG. 6 the path sensor 51 not only determines the initial and end positions A and F, but also the intermediate positions C, D, E and F. In this manner it is possible to determine whether the movements of the driven elements occur linearly, as in FIGS. 3 to 5, or whether the sequence of the movements is nonlinearly and occurs in a prefined manner. The continuous curve K1 shown in FIG. 6 lies within the predefined range thresholds X, Y with respect to the initial points and end points. At one position, however, it nearly touches the lower threshold Y. Thus, it is well possible that the driven element, which in this case is again the yarn changer apparatus 31, collides at this position (marked with arrow P) with another element such as, for example, the bobbin 13 that is swivelling out. Similar to the procedure in FIG. 4, the curve can be displaced to the left by selecting an earlier starting point $t_1$ within the window $t_{1u}$–$t_{1o}$ without allowing the initial and end points to come to lie outside of the desired ranges. This displacement, however, is only possible within very narrow margins, as otherwise the control unit 49 will initiate a counteractive correction for the arrival of the driven element outside of the time window $t_{2u}$–$t_{2o}$ due to the deviation.

If curve K2 (shown in broken lines) exceeds the range threshold Y, although the starting point and end point are within the respective time window, the control unit will initiate an alarm or stop signal. A correction will not be made in the present case as the malfunction has to be eliminated by the operating staff.

The corrections made by control unit 49 or those from previous work cycles can be recalled from memory 63. The data which are output on the display or on a printout allow drawing conclusions about deficiencies in the moved elements.

In the mentioned examples it was assumed, at was already explained above, that the elements of the machine function correctly with the moved elements. It is obviously possible to acquire data about additional elements or components such as the temporal sequence of the rotation of the revolver and to correct these, if required, in a similar manner when the deviations come to lie within tolerable limits.

Figure 7:
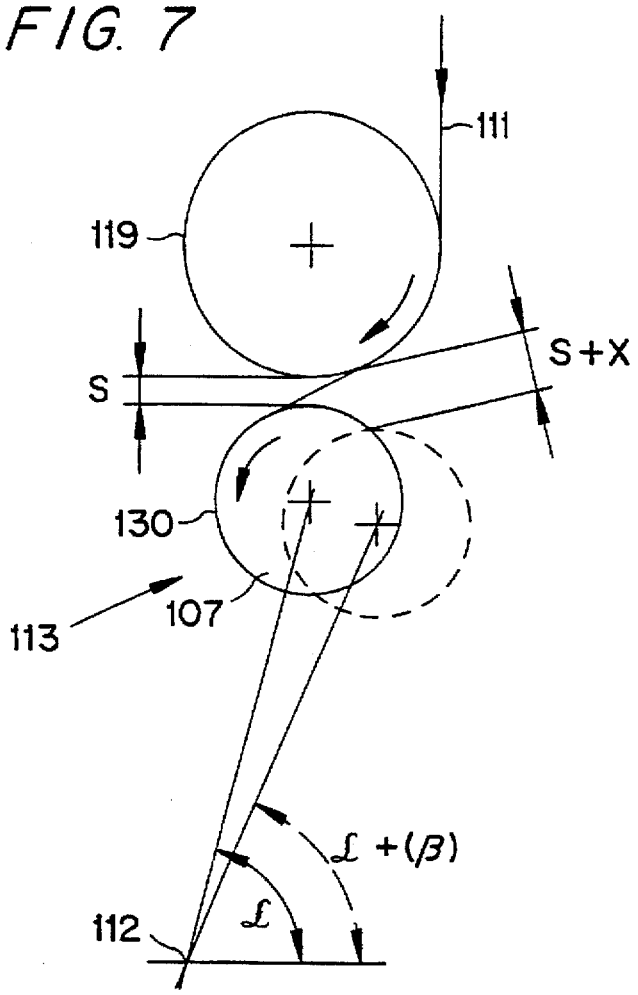
FIG. 7 shows a schematic representation of the bobbin cylinder and the tachometer roller during the filling of the gap.

In the second example of the invention in accordance with FIG. 7 the position of the empty bobbin 107 with respect to the tachometer or friction roller 119 is represented with a gap S between the surface of the tachometer roller 119 and the yarn windings 130 which are already situated on the empty bobbin 107. The width of gap S must always be of the same size within narrow limits at the beginning of the spinning, process in order to ensure that, on the one hand, concerning the contact of the bobbin surface with the tachometer roller a synchronized run between the two elements is achieved and/or that, on the other hand, the contact occurs at a previously defined time. The speed ns of bobbin 113 decreases in accordance with the rise of its diameter due to the yarn 111 which is wound up on it and is mathematically provided in such a way that in the event that gap S should be filled up and that the contact of the exterior yarn layers with the tachometer roller 119 takes place, the circumferential speeds of the two elements should be equivalent.

Even a slight deviation β from the set value of the angle α of revolver 105 will lead to the fact that the bobbin diameter of the package at the end of the package build-up is not consistent with the predefined value because the diameter is defined by the path covered by the extension arm during the bobbin build up.

The rotation of the revolver 105 is caused by a motor, 104, on whose shaft 157 a worm wheel 106 is attached. The worm wheel combs on the revolver 105 in cooperation with worm 108. In order to acquire the angle of rotation of the revolver 105, data collecting means 110 for acquiring the angle of rotation may be attached to the shaft of motor 104. One rotation of the revolver during the change of the bobbin is equivalent to 180°. This 180° rotation of the revolver 105 may be equivelant, for example, to one thousand pulses in the data collecting means 110 for the angle of rotation of the revolver. In order to achieve a rotation of the revolver until a bobbin change is made, drive motor 104 is driven until one thousand pulses have been measured. Motor 104 is stopped thereafter. Due to influences such as friction, mass of bobbin, mass of driving elements for revolver 105 (motor 104), gear, play, worm wheel 106, etc. it is possible that the drive may receive the predefined number of pulses, but revolver 105 does not come to a standstill at the planned time and/or at the desired position. It is noticed, for example, that the current actual position of revolver 105 is over the ideal end position (angle α) by a path equivalent to ten pulses when revolver 105 comes to a standstill. However, it is also noticed that this value is still within a given window of +/−20 pulses, for example. Said ten pulses over the ideal figure are recognized and aquired as a deviation by data collecting means 154, which may be part of the control unit 155, and are stored in the control unit 155. During the next rotation of the revolver a pertinent correction is made. It has also been noticed that for the precise positioning of the driven element 105 the scheduled pulse number is 990. In order to achieve the desired position during the next following rotation of the revolver it is necessary to deduct from the scheduled pulse number of 990 the ten pulses still over the set position resulting from the first rotation, so that effectively 980 pulses are required for the second rotation of the revolver. The number of 990 pulses forms the basis of the correction for the following cycle. Accordingly, the number of 988 pulses forms the basis for the following cycle.

During the measurement following the second revolver rotation the data collecting means for the angle of rotation determines that the revolver has been effectively positioned at 992 pulses (actual position). In the following correction it is thus necessary to reduce the switching path by two pulses and that therefore the two pulses have to be deducted. In other words, 986 pulses are required for the third rotation of the revolver.

Instead of the pulses described above it is also possible to use time units during which the revolver drive is activated.

The lower the deviation from the set value after the standstill of revolver motor 104, the lower the required correction. It is not possible to refrain from such corrections in general as new corrections will become necessary by play in drives, friction, etc.

Generally, however, such corrections are required to a lesser extent than at the beginning.

The data collecting means for the angle of rotation can alternatively take place directly on revolver 105, for example on its axle 112.

The zero or initial point for the first measurement may be a rigid stop or tappet 117 which is movable into the path of rotation of revolver 105 and which is engagable in pertinently provided recesses in revolver 105. During the later operation the tappet 117 is naturally not engaged in order to allow the rotation of the revolver. Similar to the acquisition of angles of rotation it is naturally also possible that deviations of linear movements are aquired, stored and pertinently corrected during the next following cycle.

As an alternative to a division into pulses it is also possible to use time intervals and analog signals as units of measurement.

Figure 8:
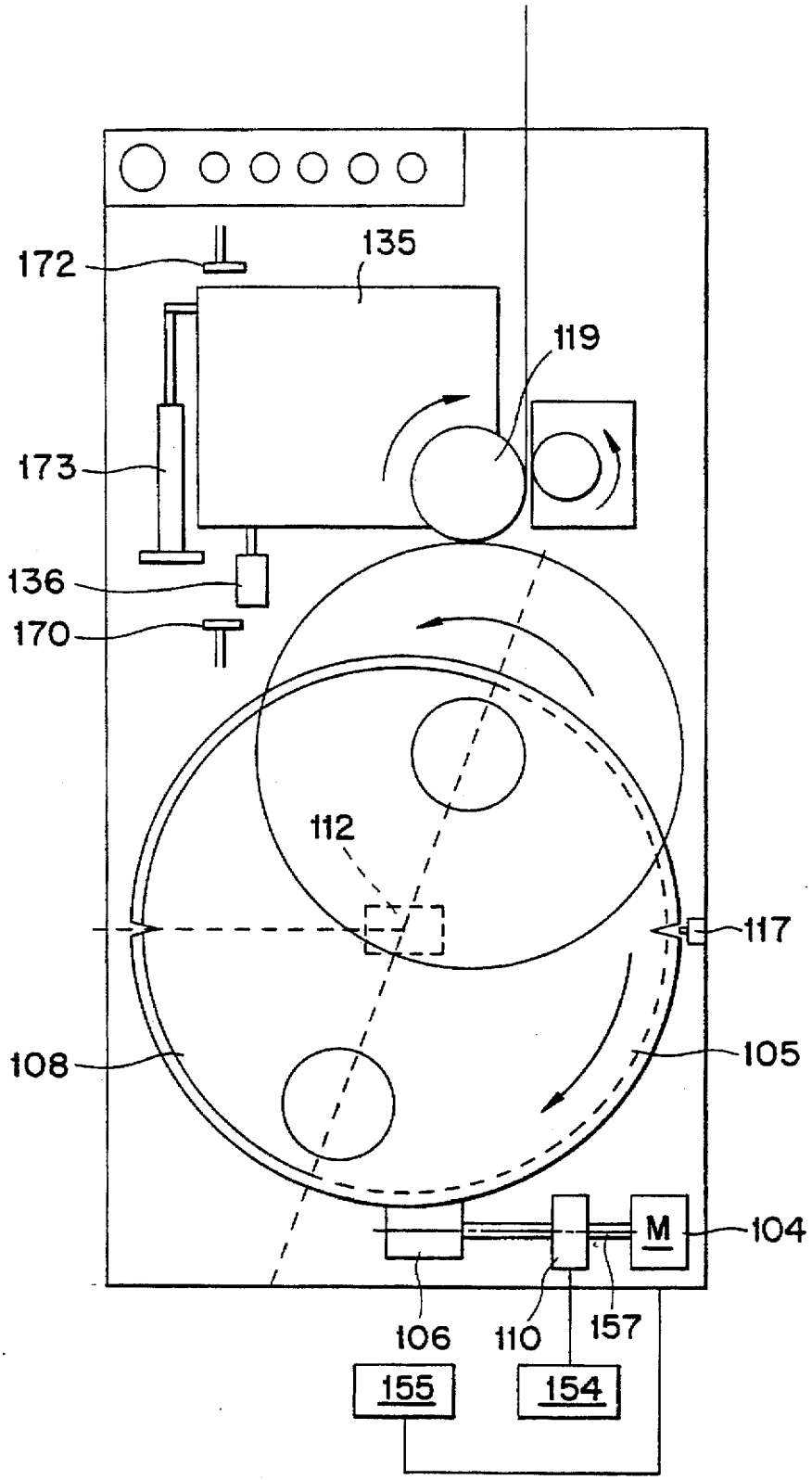
FIG. 8 shows a schematic representation of a textile machine with a revolver carrying two pegs and a tachometer roller.

The third example of the invention in accordance with FIG. 9 relates to a determination of the site at the end of a displacement of a driven element and will be explained on the basis of a vertically extending path of movement S of the extension arm 135 on the machine casing 1 in FIG. 8. The diagram in FIG. 9 shows the extension arm position with respect to the signal of the measurement system (path, length, time intervals).

Figure 9:
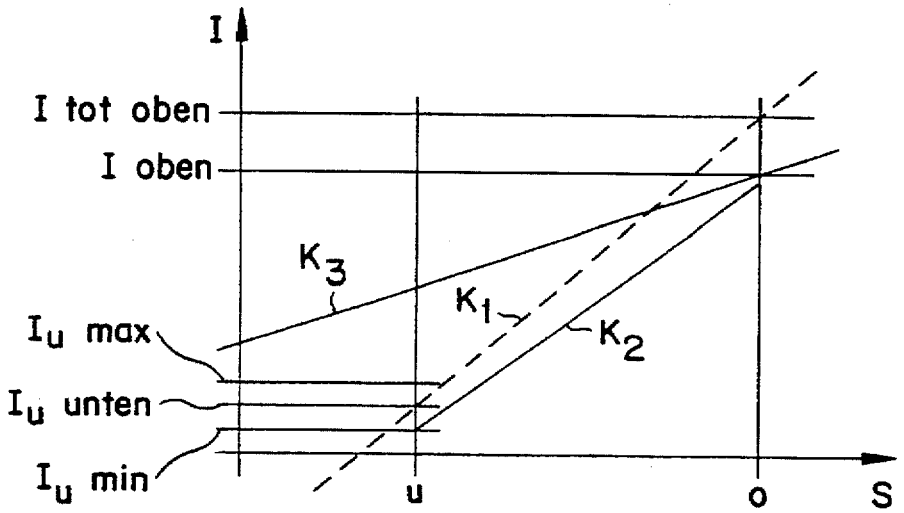
FIG. 9 shows a diagram of the movement position of the extension arm s with respect to the initial current I.

In the present example an inductive length measuring system 173 produces a signal of current I according to the curves K1, K2, K3 in FIG. 9, which signal is proportional to the extension arm movement. Both the zero point as well as the slope of the curves differ with respect to the length measuring system 173, as is produced, for example, by AIP Wild under the name IW251/220-0,5, i.e. the individual values of every device fluctuate within a certain tolerance range, which may depend (among other items) on the temperature. The "zero point" and the effective slope of the curves are determined as follows: The lowermost extension arm position "u" leads to the zero point of the system. This position is to be defined in such a way that, for example, the tachometer roller 19 attached to extension arm 135 is specifically defined with respect to peg 7, which is situated in the winding position, by a stop 170. This position is set during the installation of the machine within a narrow range of tolerance. It is not changed during the whole service life of the machine. The uppermost extension arm position "o" is also defined during the installation of the machine in such a way that the extension arm 135 passes through a precisely defined path s extending between the lowermost position "u" (stop 170) and the uppermost position "o" (stop 172). The uppermost position "o" remains unchanged during the whole service life of the machine. These two positions (uppermost and lowermost) determine the reference of output signal I to the machine (for example 5 mA for the lowermost position "u" and 15 mA for the uppermost position "o").

The initialization of the length measuring system for the measurement of the path covered by the extension arm 135 is carried out as follows: During each start-up of the machine the extension arm 135 is lowered to the lowermost position by a lifting drive 136. The lowermost position is deemed as being reached when the position of the extension arm 135 no longer changes. Then position "u" is read out and checked for plausibility. If position "u" is plausible and if the output signal lies within the predefined lower tolerance band ($I_{umin}$–$I_{umax}$), the control unit stores the lowermost position. Now extension arm 135 moves to the uppermost position "o" The uppermost position is deemed as having been reached as soon as the position of extension arm 135 no longer changes. A plausibility check is carried out again and the value of the output signal is stored.

If the signals of the length measuring system 173, i.e. the upper and the lower values, are situated within the predefined tolerance bands ($I_{umin}$–$I_{umax}$) and ($I_{omin}$–$I_{omax}$), the machine can be started (curves K1 and K2). If, however, one of the signals (as is shown in curve K3) lies above the lower tolerance band, because of a change in temperature for example, the machine has to be stopped.

Similar to the first example of the invention, a shifting of the output signal I of the length measuring system 173 is made instead of a shifting of the time of the output signal of the driving element. After the determination of $I_o$ and $I_u$ it is possible to lay narrower operating tolerance bands over points $I_o$ and $I_u$.

The extension arm position can be checked for plausibility after each lowering of extension arm 135, i.e. the signal value is tested whether or not it lies within the operating tolerance range. A plausibility check in the uppermost extension arm position is usually made after each start-up of the machine, after a yarn breakage, for example.

The operating tolerance band of the uppermost extension arm position can be selected much narrower, because the uppermost position is completely unchangeable in contrast to the lowermost position, which can be reached during the winding operation. The lowermost position is subject to the tolerances of empty bobbin 9 and, if the start-up is made with a gap, the size of the gap.

The continuity of the position values between the two extreme positions can be examined during the whole travel of the bobbin. Thus it is necessary that every position acquired must lie within the tolerance band with respect to the last position.

The length measuring system 173 or the evaluation unit can determine the slope of the curve and its position even if a clearly defined path length and absolutely defined positions in the end positions have been predetermined.

In addition to the described driving and driven elements it is also possible that other moved parts of a bobbin winding machine are monitored and corrected both temporally as well as locally with respect to their mutual movements. In particular, it is also possible to monitor and correct the axial excursions of the yarn by yarn changer apparatuses during the change of bobbins with respect to the respective position of the two bobbins and the position of the yarn changer apparatus during the sequence of the movements so as to prevent collisions and achieve a yarn guidance with precise positioning.

The apparatus for monitoring and correcting temporal or path-dependent cycles may be integrated in the machine control unit 49 and may therefore be in operation permanently. It may also be integrated in an independent diagnosing and setting device 71 which is connectable with the bobbin winding machine 3 via an interface 73 and which can be used to control and, if required, correct the functional preciseness of the moved elements of bobbin winding machines during the production or in the workshop. In both alternative arrangements there are sensors for acquiring the actual values in the bobbin winding machine. Furthermore, a data memory is also integrated in the bobbin winding machine for the storage of measured values and of the data and corrective values transmitted by an independent diagnosing and setting device.

The stationary or movable diagnosing and setting device can thus be used for evaluating and/or newly setting or calculating parameters.

The method and the apparatus in accordance with the invention are generally suitable for applications where complex cycles involving mutual movements of several actuator elements are to be controlled. Such cycles are known, for example, from EP-B-25128 and from EP-B73930.

We claim:

1. Method for the automatic change of bobbins in a bobbin winding machine, in which a predefinable yarn quantity is wound on a bobbin located at a winding position to produce a full bobbin, comprising:

moving a full bobbin from a winding position to a removal position and moving an empty bobbin from a waiting position to the winding position; transferring incoming yarn from the full bobbin to the empty bobbin; acquiring information concerning movement of at least one component of the bobbin winding machine involved in at least one of the moving of the bobbins and the transferring of the incoming yarn, the at least one component having a start time associated therewith at which a movement operation of the at least one component is initiated; comparing the acquired information with predefined limits; and correcting for deviations which lie within the predefined limits to obtain a corrected staff time for the at least one component as long as the corrected start time lies within a predefined start time range.

2. Method as claimed in claim 1, wherein information is acquired with respect to a temporal sequence of the at least one component between an initial position and a final point, wherein in the event the temporal sequence deviates from a set value range the temporal sequence is adjusted in steps until the temporal sequence comes to lie within the set value range, the adjustment in steps being made proportionally to a magnitude of the deviation.

3. Method as claimed in claim 2, wherein the set value range includes an upper and a lower limit, and including generating a signal in the event that one of the upper and lower limits is exceeded.

4. Bobbin winding machine for automatically winding yarns, comprising a driven element, a driving element connected to the driven element for driving the driven element and guiding the driven element in a predefined manner when a start time of the driving element is instituted, means for setting a predefined tolerance range within which the driven element is to reach a final point of the movement path, means for determining an actual time of arrival of the driven element at the final point, means for comparing the actual time of arrival with a predefined set time of arrival, means for recognizing a deviation between the actual time of arrival and the predefined set time of arrival, means for correcting the start time of the driving element when the actual time of arrival of the driven element lies within the predefined tolerance range.

5. Machine as claimed in claim 4, including means for turning off the machine if the actual time of arrival lies outside the predefined tolerance range.

6. Machine as claimed in claim 4, including means for setting a sequence of movement of the driven element with respect to time and path of movement.

7. Machine as claimed in claim 4, wherein the means for correcting the start time of the driving element includes means for recognizing limits of a start time range for the start time of the driving element.

8. Machine as claimed in claim 7, including means for setting upper and lower limits of a movement range of the driven element, means for recognizing an actual movement sequence of the driven element within the upper and lower limits, and means for correcting the start time of the driving element within the start time range in the event the actual movement sequence falls below a minimum distance of the upper and lower limits.

9. Method for the automatic change of bobbins in a bobbin winding machine, in which a predefinable yarn quantity is wound on a bobbin located at a winding position to produce a full bobbin, comprising:

moving a full bobbin from a winding position to a removal position and moving an empty bobbin from a waiting position to the winding position;

transferring incoming yarn from the full bobbin to the empty bobbin;

acquiring information concerning movement of at least one component of the bobbin winding machine involved in at least one of the moving of the bobbins and the transferring of the incoming yarn;

comparing the acquired information with predefined limits; and changing a movement characteristic associated with movement of the at least one component to correct for deviations which lie within the predefined limits.

10. Method as claimed in claim 9, wherein the at least one component moves between an initial position and an end position, the step of acquiring information concerning movement of at least one component of the bobbin winding machine including acquiring information concerning arrival of the at least one component at the end position.

11. Method as claimed in claim 9, wherein the at least one component moves between an initial position and an end position, the at least one component having a start time associated therewith at which the at least one component starts moving from the initial position and having an arrival time associated therewith at which the at least one component ceases movement, the step of changing a movement characteristic associated with movement of the at least one component being performed to alter the arrival time of the at least one component.

12. Method as claimed in claim 11, wherein the step of changing a movement characteristic associated with movement of the at least one component includes changing the start time of the at least one component to alter the arrival time of the at least one component.

13. Method as claimed in claim 11, wherein the at least one component has a start time associated therewith at which the at least one component starts moving from the initial position, the step of changing a movement characteristic associated with movement of the at least one component including changing the start time of the at least one component.

14. Method as claimed in claim 9, wherein the at least one component moves between an initial position and an end position, the at least one component having a start time associated therewith at which the at least one component starts moving from the initial position and having an arrival time associated therewith at which the at least one component ceases movement, the step of acquiring information concerning movement of at least one component of the bobbin winding machine including acquiring information concerning the arrival time of the at least one component, the step of comparing the acquired information with predefined limits including comparing the arrival time to predefined limits for the arrival time.

15. Bobbin winding machine for automatically winding yarns, comprising a driven element, a driving element connected to the driven element for driving the driven element in a predefined manner to move the driven element, monitoring means for monitoring movement of the driven element to acquire information concerning the movement of the driven element, comparing means for comparing the information acquired concerning movement of the driven element with predefined limits, means for changing a movement characteristic associated with movement of the driven element to correct for deviations which lie within the predefined limits.

16. Machine as claimed in claim 15, including means for turning off the machine if the information acquired concerning movement of the driven element lies outside the predefined limits.

17. Machines as claimed in claim 16, wherein the means for changing the movement characteristic includes means for changing the start time of said driven element.

18. Machine as claimed in claim 15, wherein the means for changing a movement characteristic associated with movement of the driven element includes means for altering a start time of the driven element at which movement of the driven element is initiated.

19. Method for automatic change of bobbins in a bobbin winding machine, in which a predefinable yarn quantity is wound on a bobbin located at a winding position to produce a full bobbin, comprising:

moving a full bobbin from a winding position to a removal position and moving an empty bobbin from a waiting position to the winding position, the full bobbin and empty bobbin being mounted on a revolver;

transferring incoming yarn from the full bobbin to the empty bobbin through use of a yarn transfer device that moves between an initial position and an end position;

acquiring information concerning movement of the yarn transferring device in dependence upon movement of the revolver;

comparing the acquired information with predefined limits at at least one of the initial position and the end position; and changing a movement characteristic associated with movement of the yarn transferring device to correct for deviations which lie within the predefined limits.

20. Method as claimed in claim 19, wherein the changing of the movement characteristic involves changing the start time of the movement of the transferring of the incoming yarn.

* * * * *